US011821703B2

(12) United States Patent
Santa et al.

(10) Patent No.: US 11,821,703 B2
(45) Date of Patent: Nov. 21, 2023

(54) BREECH GUIDE DEVICE OF A SEMIAUTOMATIC OR AUTOMATIC FIREARM

(71) Applicant: Carl Walther GmbH, Ulm (DE)

(72) Inventors: Philipp Santa, Ulm (DE); Christoph Gröner, Hetschwang (DE); Eyck Pflaumer, Arnsberg (DE); Martin Wonisch, Arnsberg (DE)

(73) Assignee: Carl Walther GmbH, Ulm (DE)

( * ) Notice: Subject to any disclaimer, the term of this patent is extended or adjusted under 35 U.S.C. 154(b) by 0 days.

(21) Appl. No.: 17/868,031

(22) Filed: Jul. 19, 2022

(65) Prior Publication Data

US 2023/0022273 A1 Jan. 26, 2023

(30) Foreign Application Priority Data

Jul. 20, 2021 (DE) ..... 10 2021 118 639.0

(51) Int. Cl.
*F41A 3/66* (2006.01)

(52) U.S. Cl.
CPC ..... *F41A 3/66* (2013.01)

(58) Field of Classification Search
CPC ..... F41A 3/66
USPC ..... 89/183, 160, 141, 194–196; 42/16
See application file for complete search history.

(56) References Cited

U.S. PATENT DOCUMENTS 2,717,464 A 9/1955 Marcati
5,604,326 A 2/1997 Lescure
5,678,340 A 10/1997 Moon
8,028,454 B1 10/2011 Pontillo, II
8,333,142 B1 12/2012 Karfiol et al.
8,739,445 B2 * 6/2014 Burke ..... F41A 11/02 42/16
8,966,800 B1 3/2015 Olson
9,518,791 B1 12/2016 Heizer et al.
9,746,283 B2 8/2017 Braun
(Continued)

FOREIGN PATENT DOCUMENTS

DE 202004009229 U1 11/2005
EP 0786640 A1 7/1997
(Continued)

OTHER PUBLICATIONS

German Office Action dated Dec. 9, 2020 for German Patent Application No. 10 2020 108 231.2.
Exploded drawing and parts list: "Creed", Jun. 8, 2016, Carl Walther GmbH, Ulm, Germany.
Exploded drawing and parts list: "PPQ", Jan. 11, 2018, Carl Walther GmbH, Ulm, Germany.
(Continued)

*Primary Examiner* — Reginald S Tillman, Jr.
(74) *Attorney, Agent, or Firm* — Bachman & LaPointe, P.C.

(57) ABSTRACT

In a guide device (100) for guiding a slide (300) of a semiautomatic or automatic firearm along an upper part of a frame (200) during a sliding movement in connection with the firing of a cartridge (400), a narrow design of a slide (300) is made possible when a double-stack magazine (210) is used, in that a slideway which allows sliding between the frame (200) and slide (300) is divided into two segments (220, 240), a first segment (220) being arranged remote from barrel (230) of the firearm behind a magazine chamber (211) designed to receive a magazine (210) containing cartridges (400), and a second segment (240) being arranged close to the barrel (230) in front of the magazine chamber (211).

20 Claims, 4 Drawing Sheets

(56) References Cited

U.S. PATENT DOCUMENTS

| | | | | |
|---|---|---|---|---|
| 11,022,387 | B1 * | 6/2021 | Noonan | F41C 3/00 |
| 2006/0185212 | A1 | 8/2006 | Curry et al. | |
| 2011/0041680 | A1 | 2/2011 | Smirnov | |
| 2014/0196339 | A1 | 7/2014 | Zukowski et al. | |
| 2016/0231075 | A1 | 8/2016 | Wolf | |
| 2017/0261279 | A1 | 9/2017 | Lee | |
| 2017/0328656 | A1 | 11/2017 | O'Clair et al. | |
| 2018/0031341 | A1 | 2/2018 | Bubits | |
| 2018/0087857 | A1 | 3/2018 | Davis et al. | |
| 2018/0112944 | A1 | 4/2018 | Underwood et al. | |
| 2021/0318085 | A1 | 10/2021 | Kling et al. | |
| 2021/0364244 | A1 | 11/2021 | Kling et al. | |

FOREIGN PATENT DOCUMENTS

| | | | |
|---|---|---|---|
| GB | 500621 | A | 2/1939 |
| WO | 2016/127194 | A1 | 8/2016 |

OTHER PUBLICATIONS

Exploded drawing and parts list: "PPX M1", Jul. 28, 2014, Carl Walther GmbH, Ulm, Germany.
U.S. Office action dated Mar. 17, 2022 for U.S. Appl. No. 17/159,438.
"Spare Parts Catalogue: SFP9-SF Pistol", Sep. 2015, Heckler & Koch GmbH, Oberndorf, Germany.
German Office Action dated Mar. 7, 2022 for German Patent Application No. 102021118639 (with electronic translation).

* cited by examiner

BREECH GUIDE DEVICE OF A SEMIAUTOMATIC OR AUTOMATIC FIREARM

CROSS-REFERENCE TO RELATED APPLICATION

Priority is claimed of German Patent Application No. DE 10 2021 118 639.0, filed Jul. 20, 2021, and entitled "Breech Guide Device of a Semiautomatic or Automatic Firearm", the disclosure of which is incorporated by reference herein in its entirety as if set forth at length.

BACKGROUND

The present invention relates to a slide guide device for guiding a slide of a semiautomatic or automatic firearm during a sliding movement along an upper part of a frame in connection with the firing of a cartridge.

In particular, the present invention relates to a slide guide device of a frame of a pistol, for interacting with a pistol slide, having a main functional region arranged in a central recess, in which main functional region a cartridge holder (cartridge stripper/pickup/center rail) with two sides and a cartridge sliding face is arranged, wherein the cartridge sliding face abuts an uppermost of the cartridges stored in a magazine, when the slide is in a forward/extended/closed position, so that said cartridge is held in a predefined position in the magazine.

Furthermore, the present invention relates to a slide of a pistol having a main functional region arranged in a central recess of the slide, in which main functional region a cartridge holder with two sides and a cartridge sliding face is arranged, wherein the cartridge sliding face abuts an uppermost of the cartridges stored in the magazine, when the breech is in a forward/extended/closed position, so that said cartridge is held in a predefined position in the magazine.

Stripper devices of the kind referred to above are used in the prior art, in particular, to introduce, in collaboration with a grip of a pistol, a cartridge from a magazine that can be introduced into the grip into the cartridge chamber of a barrel of the pistol and, following an ignition of the cartridge in conjunction with the firing of a shot and a pulse transmission connected thereto from the cartridge casing to the breech section of the slide, and a movement of the slide connected thereto in the opposite direction to the projectile leaving the cartridge case, to remove the empty cartridge case from the barrel, and then introduce a further cartridge from the magazine into the cartridge chamber.

In order to guide a corresponding sliding movement of the breech section of the slide in relation to the frame, in the prior art lateral guide rails are provided in the region of the opposite upper edges of said frame, which guide rails engage with corresponding lateral grooves in the slide for the purpose of securely guiding a relative movement between the breech section and frame.

SUMMARY

However, the guide devices, particularly the breech section guide devices, known in the art have the disadvantage that their design, taken in conjunction with a widely configured double-stack magazine, causes the slide to have a correspondingly wide design.

The problem addressed by the invention is therefore that of creating a guide device which, when a widely configured double-stack magazine is used, nevertheless allows the slide to have a narrow design by comparison with the prior art.

For a guide device of the kind referred to above, this problem is solved according to the invention in that a slideway allowing sliding between the frame and slide is divided into two segments, a first segment of which is arranged remote from a barrel of the firearm behind a magazine chamber (magazine well) designed to receive a magazine containing cartridges, and a second segment is arranged close to the barrel in front of the magazine chamber.

Preferred embodiments of the invention are the subject matter of the dependent claims, the elements of which act as a further improvement in the approach to solving the problem underlying the invention.

In the case of the slide guide device according to the invention, by means of the combination of features of the characterizing part of the independent patent claim in conjunction with the characterizing clause thereof, it is achieved that a guide strip to the side of the widely configured double-stack magazine is expendable and a comparatively narrow embodiment of the slide can thereby be achieved.

According to the invention, the uniformly continuous guide rails of the frame and of the slide, which are known from the prior art and lie externally on the side, are therefore divided into guide mechanisms lying on the frame in front of the magazine chamber and guide rails lying within the breech configured behind the magazine chamber, for example on a cartridge sliding body arranged centrally on the underside of the breech section of the slide.

In accordance with a first preferred embodiment of the slide guide device according to the invention, it is provided that the first segment of the slide contains guide devices on a sliding body (cartridge stripper/pickup/center rail) oriented in the direction of the longitudinal axis of the slide and centrally in the breech section, and the second segment of the slide contains guide devices in the region of the side panels of the slide.

In accordance with an important preferred embodiment of the slide guide device according to the invention, the sliding body is formed by a cartridge sliding body (cartridge stripper/pickup/center rail) fixedly arranged in a central recess of the slide, the undersurface of said cartridge sliding body being configured as a cartridge sliding face which abuts an uppermost of the cartridges stored in a magazine, so that said cartridge is held in a predefined position in the magazine.

The first segment of the frame is preferably configured as a first insert which is fixedly integrated in the frame body in a part of said frame body located remote from the barrel behind the magazine chamber.

Furthermore, the first insert is preferably provided with guide mechanisms which interact with guide mechanisms configured on a cartridge sliding body (cartridge stripper/pickup/center rail) fixedly connected to the breech section, in order to perform a linear movement between said breech section and frame through firing of a cartridge located in a cartridge chamber of the barrel. The guide elements in this case may be arranged, in particular, in the region of the lateral faces of the cartridge sliding body.

According to a further preferred embodiment of the slide guide device according to the invention, the guide mechanisms in the first insert of the frame are designed as two guide projections lying opposite one another, for receiving and for sliding interaction with the respective guide elements configured as guiding grooves on the side panels of the cartridge sliding body (cartridge stripper/pickup/center rail).

The second segment of the frame is preferably likewise configured as a second insert which is fixedly integrated in the frame body in a part of said frame body located close to the barrel in front of the magazine chamber.

The second insert of the frame in this case is, in particular, provided with guide devices which interact, in particular, with lateral guide mechanisms configured on the slide, in order to perform a linear movement between the slide and frame by way of a firing of a cartridge located in a cartridge chamber of the barrel.

The lateral guide mechanisms of the slide in this case may, in particular, be configured as guide grooves oriented towards the inside of the breech and configured in the region of the side panels of said slide, wherein the guide mechanisms of the second insert are configured as guide rails.

To the side of the cartridge sliding body, a cartridge ejector may, in particular, be provided, which is integrally configured with the first insert. An embodiment of this kind is simultaneously highly robust and solid and easy to produce.

In accordance with a further preferred embodiment of the slide guide device according to the invention, the second front insert has a lower boundary face as the stop face for an upper bearing surface of a magazine located in the magazine chamber, so that the magazine is held in a fail-safe position in respect of the cartridge sliding body, on the one hand, and the cartridge ejector, on the other.

BRIEF DESCRIPTION OF THE DRAWINGS

The breech guide device according to the invention is explained in the following with the help of a preferred embodiment which is depicted in the figures of the drawing. In the drawing.

DETAILED DESCRIPTION

Figure 1:
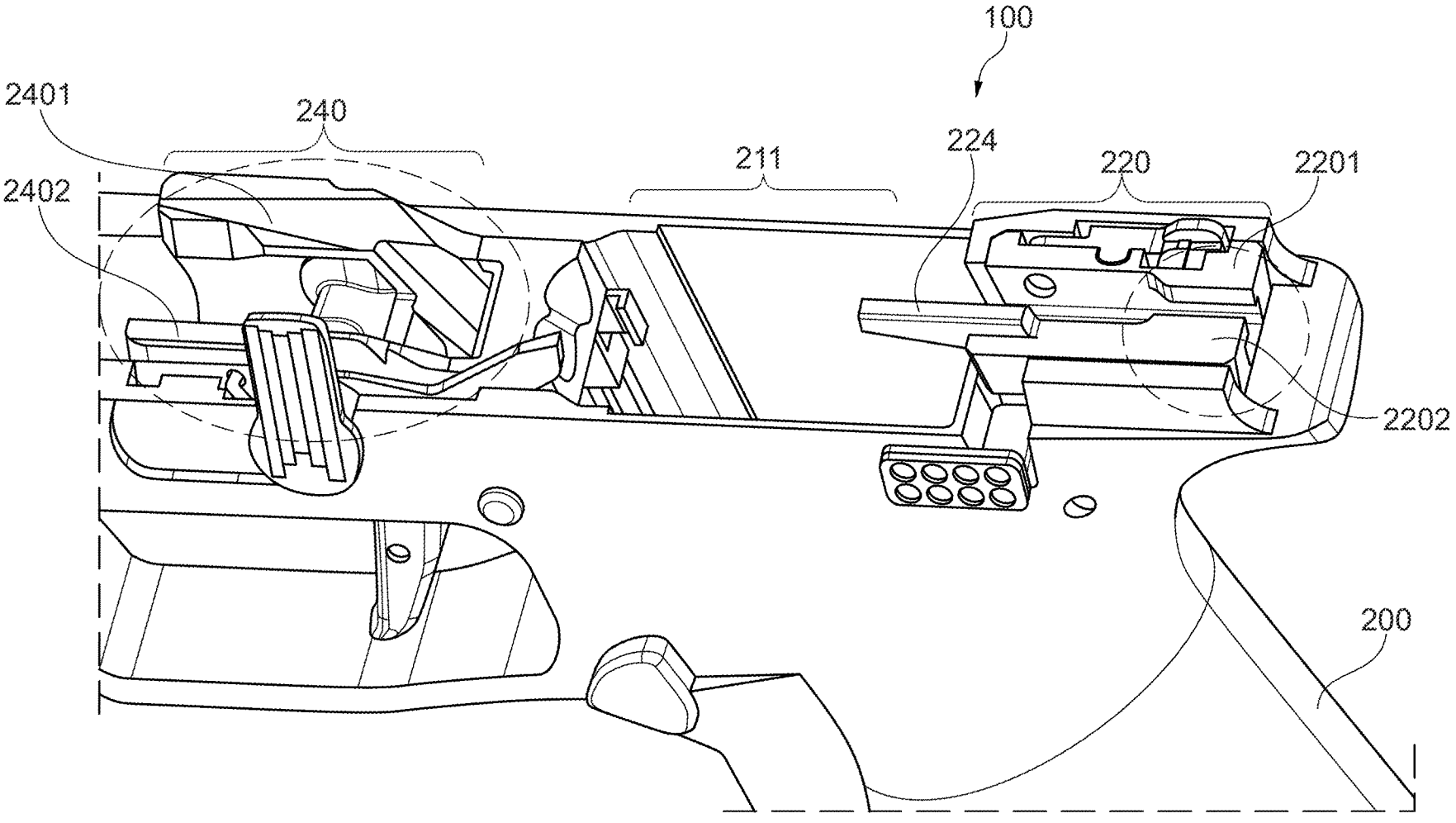
FIG. 1 shows a preferred embodiment of a frame section of a guide device according to the invention in an oblique view from above.
Figure 2:
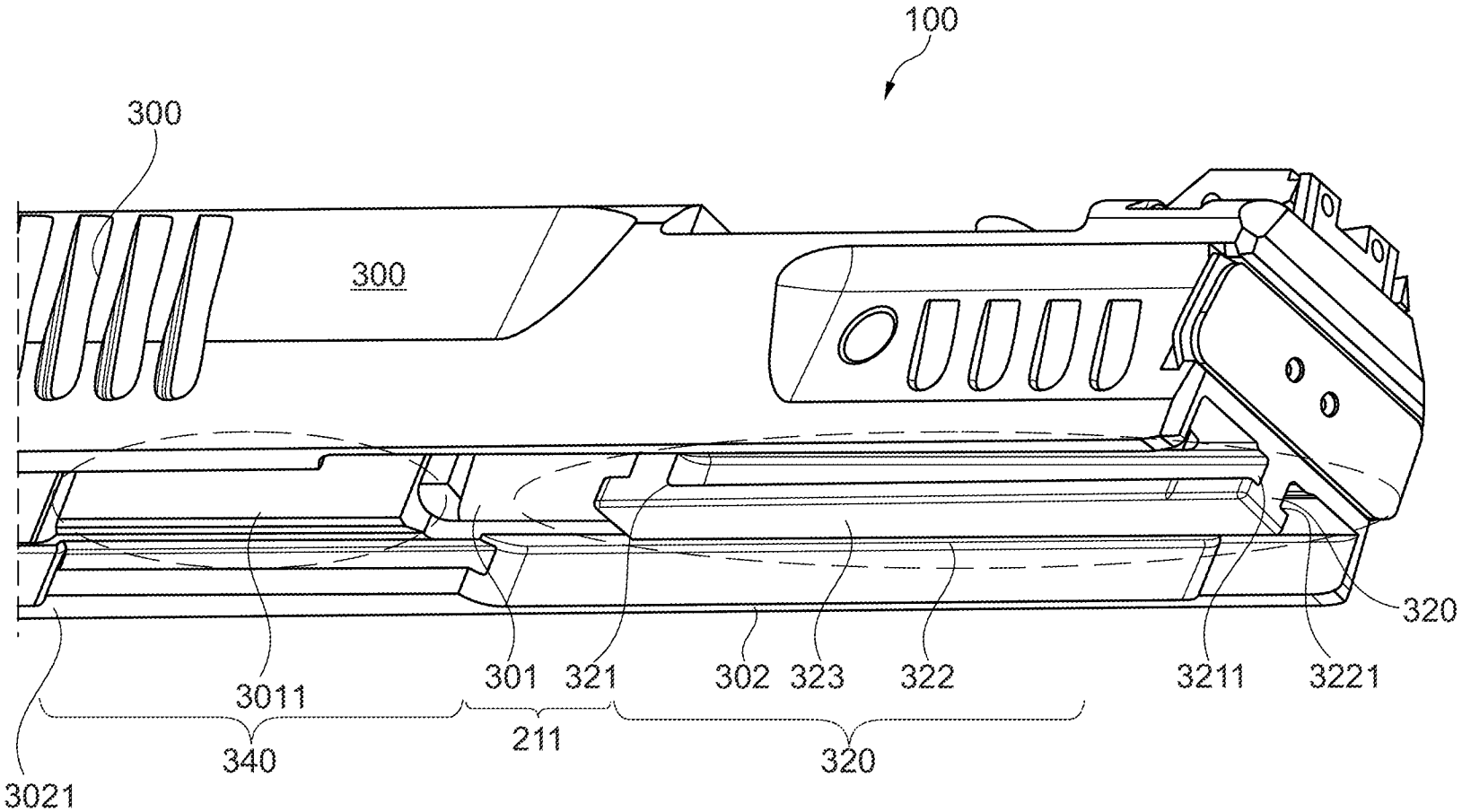
FIG. 2 shows a preferred embodiment of a slide section of the guide device according to the invention depicted in FIG. 1 in an oblique view from below.
Figure 3:
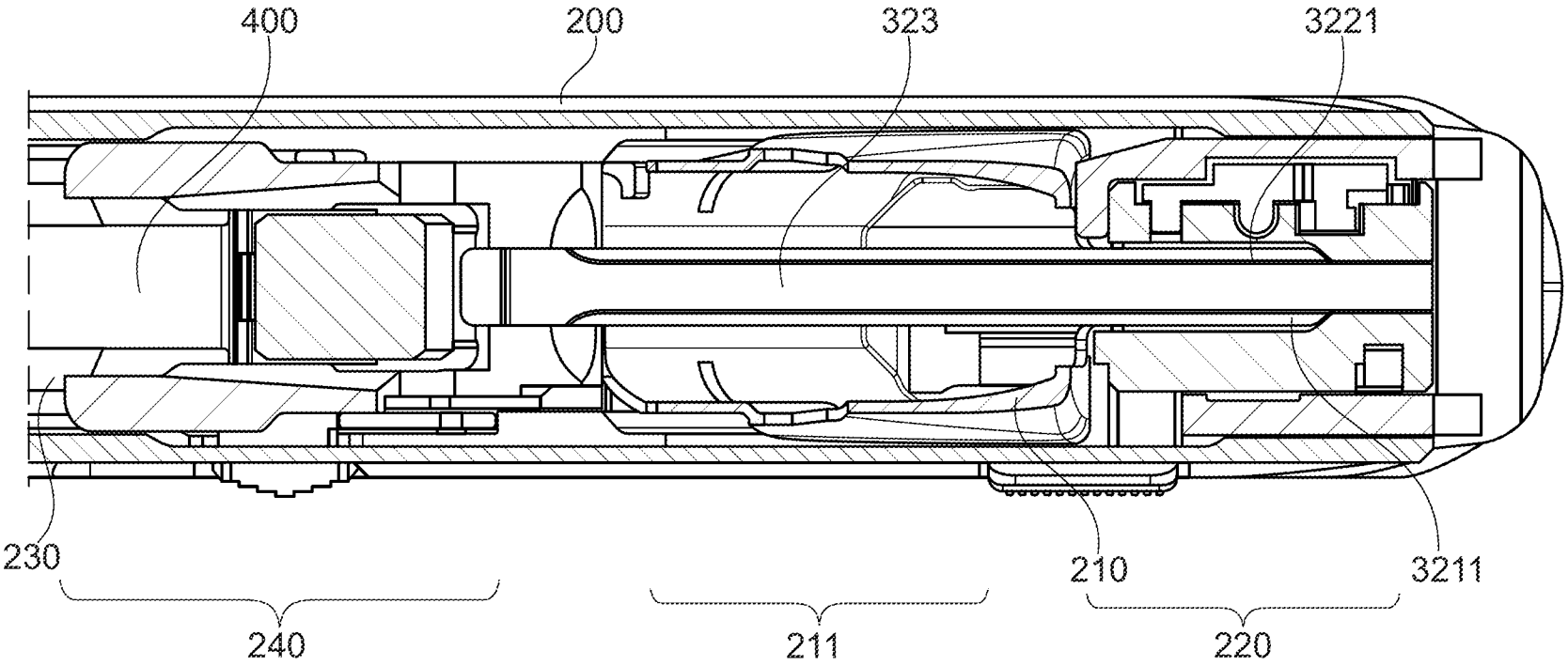
FIG. 3 shows the preferred embodiment of the guide device according to the invention depicted in FIG. 2 in a sectional view from above.
Figure 4:
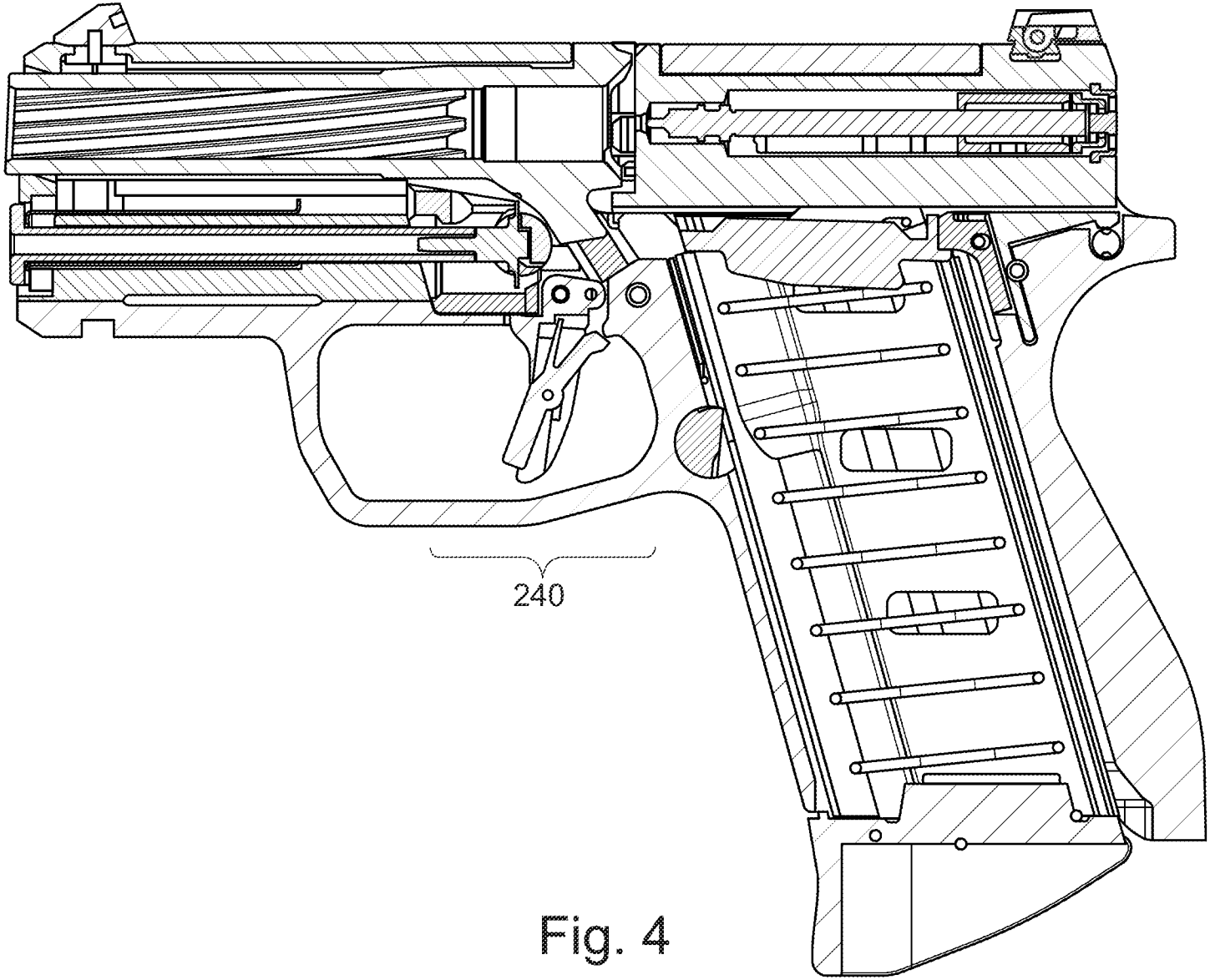
FIG. 4 shows the position of the part of the second segment of the breech guide device according to the invention depicted in FIGS. 1 to 3 within a pistol, in a central vertical cross-sectional view.

The slide guide device 100 according to the invention depicted in FIGS. 1 to 4 is provided for guiding a the slide 300 of a semiautomatic firearm along an upper part of a frame 200 during a sliding movement in connection with the firing of a cartridge 400 and contains a slideway divided into two segments 220, 240, which allows a sliding movement between the frame 200 and slide 300.

A first segment 220 in this case is arranged remote from the barrel 230 of the firearm behind a magazine chamber (magazine well) 211 designed to receive a magazine 210 containing cartridges 400, and a second segment 240 in this case is arranged close to the barrel 230 in front of the magazine chamber 211.

The first segment 320 of the slide 300 contains guide elements 3211, 3221 which are attached to (shown unitarily formed with) a cartridge sliding body (cartridge stripper/pickup/center rail) 320 oriented in the direction of the longitudinal axis of the slide 300 and located centrally in the slide 300, and the second segment 340 of the slide 300 contains guide mechanisms 3011, 3021, which are located in the region of the side panels 301, 302 of the slide 300.

The cartridge sliding body (stripper/pickup/center rail) 320 is fixedly arranged in a central recess of the breech section of the slide 300, the undersurface of said cartridge sliding body being configured as a cartridge sliding face 323 which abuts an uppermost of the cartridges 400 stored in a magazine 210, when the slide 300 is in a forward/extended/closed position, so that said cartridge is held depressed in the predefined position in the magazine 210.

The first segment 220 of the frame 200 is configured as a first insert 220 which is fixedly integrated in the grip section of the frame 200 (e.g., a polymer body of the frame forming the grip section) in a part of said frame 200 located remote from the barrel 230 behind the magazine chamber 211.

The first insert 220 of the frame 200 is provided with guide mechanisms 2201, 2202 (forming an inverted T-sectioned slot) which interact with guide mechanisms 3211, 3221 configured on the cartridge sliding body 320 (forming a T-sectioned rail received in the slot) fixedly connected to the slide 300, in order to perform a linear movement between said slide 300 and frame 200 through firing of a cartridge 400 located in a cartridge chamber of the barrel 230.

The guide elements 3211, 3221 are arranged in the region of the lateral faces 321, 322 of the cartridge sliding body 320.

In the first insert 220 of the frame 200, the guide mechanisms 2201, 2202 are designed as two guide projections 2201, 2202 lying opposite one another, for receiving and for sliding interaction with the respective guide elements configured as guiding grooves 3211, 3221 on the sides 321, 322 of the cartridge sliding body 320.

The second segment 240 of the frame 200 is configured as a second insert 240 which is fixedly integrated in the frame 200 in a part of said frame 200 located close to the barrel 230 in front of the magazine chamber 211.

The second insert 240 of the frame 200 is provided with guide devices 2401, 2402, is provided with guide devices 2401, 2402, which interact with lateral guide mechanisms 3011, 3021 configured on the slide 300, in order to perform a linear movement between the slide 300 and frame 200 by way of a firing of a cartridge 400 located in a cartridge chamber of the barrel 230.

The lateral guide mechanisms 3011, 3021 of the slide 300 are configured as guide grooves 3011, 3021 oriented towards the inside of the slide 300 and configured in the region of the side panels 301, 302 of said slide 300, and the guide mechanisms 2401, 2402 of the second insert 240 are configured as guide rails 2401, 2402.

To the side of the cartridge sliding body 320, a cartridge ejector 224 may be provided, which is integrally configured with the first insert 220.

The second front insert 240 has a lower boundary face, which is not depicted, as the stop face for an upper bearing surface of a magazine 210 located in the magazine chamber 211, so that the magazine 210 is held in a fail-safe position in respect of the cartridge sliding body 320, on the one hand, and the cartridge ejector 224, on the other.

Manufacture and use may be otherwise conventional in the art.

The exemplary embodiment of the invention explained above serves simply to provide greater understanding of the inventive teaching embodied in the claims, which is not limited as such by the exemplary embodiment.

LIST OF REFERENCE SIGNS

Below is a list of reference signs used in the drawings:

100 slide guide device
200 frame
210 magazine
211 magazine chamber
220 first segment
224 cartridge ejector
320 first insert
240 second segment
340 second insert
230 barrel
300 slide
301, 302 side panels of the slide
320 cartridge sliding body (stripper rail)
321, 322 sides of the cartridge sliding body
323 cartridge sliding face
400 cartridge
2201, 2202 guide mechanisms of the first insert designed as guide projections
2401, 2402 guide mechanisms of the second insert designed as guide projections
3011, 3021 guide mechanisms of the slide designed as a guide groove
3211, 3221 guide elements of the cartridge sliding body of the slide designed as a guide groove

What is claimed is:

1. A guide device (100) for guiding a slide (300) of a semiautomatic or automatic firearm along an upper part of a frame (200) during a sliding movement in connection with the firing of a cartridge (400), characterized in that:

a slideway which allows sliding between the frame (200) and slide (300) is divided into two segments (220, 320; 240, 340), a first segment (220, 320) being arranged remote from barrel (230) of the firearm behind a magazine chamber (211) designed to receive a magazine (210) containing cartridges (400), and a second segment (240, 340) being arranged close to the barrel (230) in front of the magazine chamber (211);

the first segment (320) of the slide (300) contains guide elements (3211, 3221) on a sliding body (320) oriented in the direction of the longitudinal axis of the breech (300) and centrally in the slide (300);

the second segment (340) of the slide (300) contains guide mechanisms (3011, 3021) on the side panels (301, 302) of the slide (300); and said sliding body (320) is formed by a cartridge sliding body (320) fixedly arranged in a central recess of the slide (300), the undersurface of said cartridge sliding body being configured as a cartridge sliding face (323) which abuts an uppermost of the cartridges (400) stored in a magazine (210), when the slide (300) is in a closed position, so that said cartridge is held in the predefined position in the magazine (210).

2. The guide device (100) according to claim 1 characterized in that said sliding body (320) has a T-section.

3. The guide device (100) according to claim 1, characterized in that the first segment (220) of the frame (200) is configured as a first insert (220) which is fixedly integrated in the frame (200) in a part of said frame (200) located remote from the barrel (230) behind the magazine chamber (211).

4. The guide device (100) according to claim 3, characterized in that the first insert (220) of the frame (200) is provided with guide mechanisms (2201, 2202) which interact with guide elements (3211, 3221) configured on a cartridge sliding body (320) fixedly connected to the slide (300), in order to perform a linear movement between said slide (300) and frame (200) through firing of a cartridge (400) located in a cartridge chamber of the barrel (230).

5. The guide device (100) according to claim 4, characterized in that the guide elements (3211, 3221) are arranged in the region of the lateral faces (321, 322) of the cartridge sliding body (320).

6. The guide device (100) according to claim 3, characterized in that in the first insert (220) of the frame (200), the guide mechanisms (2201, 2202) are designed as two guide projections (2201, 2202) lying opposite one another, for receiving and for sliding interaction with the respective guide elements configured as guiding grooves (3211, 3221) on the sides (321, 322) of the sliding body (320).

7. The guide device (100) according to claim 1, characterized in that the second segment (240) of the frame (200) is configured as a second insert (240) which is fixedly integrated in the frame (200) in a part of said frame (200) located close to the barrel (230) in front of the magazine chamber (211).

8. The guide device (100) according to claim 7, characterized in that the second insert (240) of the frame (200) is provided with guide devices (2401, 2402) which interact with lateral guide mechanisms (3011, 3021) configured on the slide (300), in order to perform a linear movement between the slide (300) and frame (200) by way of a firing of a cartridge (400) located in a cartridge chamber of the barrel (230).

9. The guide device (100) according to claim 8, characterized in that the guide mechanisms (2401, 2402) of the second insert (240) are configured as guide rails (2401, 2402).

10. A semiautomatic or automatic firearm comprising:

a frame (200);

a barrel (230);

a slide(300); and a magazine well (211) for receiving a magazine (210), wherein:

the slide has a pair of forward guide rails;

the frame has a pair of forward guide rails interfitting with the slide pair of forward guiderails;

the slide has a central rear rail structure;

an undersurface of the central rear rail structure abuts an uppermost of cartridge (400) stored in the magazine (210), when the slide (300) is in a closed position; and the frame has a pair of rear rails interfitting with respective sections of the central rear rail structure.

11. The semiautomatic or automatic firearm of claim 10 wherein:

the central rear rail sructure is a T-sectioned rail.

12. The semiautomatic or automatic firearm of claim 11 wherein:

the slide pair of forward guiderails are formed by repective inward projections from side panels of the slide; and the central rear rail sructure is spaced inwardly from the respective side panels of the slide.

13. A semiautomatic or automatic firearm comprising:

a barrel (230);

a slide (300) carrying the barrel and having a pair of guide rails;

a frame (200) having a pair of guide rails engaging the slide guide rails ;

wherein the slide has a T-sectioned stripper rail rearward of the slide guide rails; and the frame has a slot receiving the stripper rail.

14. The semiautomatic or automatic firearm of claim 13 wherein:

the slot is an inverted T-sectioned slot.

15. The semiautomatic or automatic firearm of claim 14 being a semiautomatic pistol further comprising:

a magazine well for receiving a magazine.

16. The semiautomatic or automatic firearm of claim 13 being a semiautomatic pistol further comprising:

a magazine well for receiving a magazine.

17. The semiautomatic or automatic firearm of claim 16 further comprising:

a magazine in the magazine well.

18. The semiautomatic or automatic firearm of claim 10 wherein:

the slide pair of forward guiderails are formed by repective inward projections from side panels of the slide; and the central rear rail sructure is spaced inwardly from the respective side panels of the slide.

19. The semiautomatic or automatic firearm of claim 10 wherein:

the pair of rear rails of the frame are on an insert (220).

20. The semiautomatic or automatic firearm of claim 10 being a semiautomatic pistol further comprising:

a magazine well for receiving a magazine.

* * * * *